United States Patent [19]

Forde et al.

[11] Patent Number: 4,867,108

[45] Date of Patent: Sep. 19, 1989

[54] POSITIVE ELECTROSTATIC POWER SYSTEM

[76] Inventors: Louis L. Forde; Diane Forde, both of 482 Berriman St., Brooklyn, N.Y. 11208

[21] Appl. No.: 174,176

[22] Filed: Mar. 28, 1988

Related U.S. Application Data

[63] Continuation-in-part of Ser. No. 894,770, Aug. 8, 1986, abandoned, which is a continuation-in-part of Ser. No. 73,463, May 15, 1985, abandoned.

[51] Int. Cl.[4] ..... F02B 71/00

[52] U.S. Cl. ..... 123/46 E; 123/169 R; 123/1 R; 123/2

[58] Field of Search ..... 123/169, 46 E, 163, 123/193 P, 1 R

[56] References Cited

U.S. PATENT DOCUMENTS 682,856 9/1901 Matthias ..... 123/163
713,194 11/1902 Bean ..... 123/163
3,349,760 10/1967 Horan ..... 123/163
4,213,428 7/1980 Bradley ..... 123/40 E
4,524,498 6/1985 Hartsock ..... 123/193 P
4,649,806 3/1987 Hartsock ..... 123/193 P
4,651,629 3/1987 Castarada ..... 123/193 P

*Primary Examiner*—Raymond A. Nelli
*Attorney, Agent, or Firm*—Darby & Darby

[57] ABSTRACT

A power supplementing system for an engine utilizes the selective delivery of electrical charge to a plate in the vicinity of a driving member of the engine, e.g. a piston, to increase the power of the engine. A high voltage AC signal is generated from a lower voltage DC signal by chopping the DC signal and applying it to a step-up transformer. The output of the transformer is rectified and stored in a capacitor. Through the use of cams or actuators on the crankshaft of the engine the charge is applies to the plate so as to attract or repulse the piston at the proper time to supplement its motion.

15 Claims, 1 Drawing Sheet

POSITIVE ELECTROSTATIC POWER SYSTEM

BACKGROUND OF THE INVENTION

This application is a continuation-in-part of application Ser. No. 894,770, filed Aug. 8, 1986, which in turn is a continuation-in-part of Ser. No. 73,463, filed on May 15, 1985, both of which are now abandoned.

The present invention relates to the use of high voltage charges to supplement the power of internal combustion engines. More specifically, the present invention relates to an electrostatic system which applies a high voltage to the piston in each cylinder of an internal combustion engine at the proper time in the piston cycle to supplement the combustion forces causing it to move.

The boost pressure provided by prior art devices employing turbochargers during the admission phase in internal combustion engines is seldom over 8 pounds per square inch gauge. But even this modest boost in pressure is capable of increasing horsepower by around 50%.

The disadvantages of engines that depend upon pneumatic boost pressures include (1) a large increase in the quantities of exhaust pollutants and (2) reduced performance when there are changes in altitude or atmospheric pressure.

Prior art electric motor driven devices include: fuel pumps, windshield wipers, fans, blowers, engine self-starters, etc. However, these do not rely on a combination of internal combustion energy and electrical energy.

An internal combustion engine typically has at least two cylinders in which pistons connected to the drive shaft are attached. An air-fuel mixture is inserted into the cylinder and is ignited by a spark from a spark plug such as to cause an explosion in the cylinder which applies force to the piston and causes it to move. Typically, the spark from the spark plug is created at the point in the cycle when the piston is very close to the spark plug and the gases have been compressed. The spark plug essentially applies a high voltage between its tip and an extended member which causes a spark that ignites the fuel-air mixture. However, a small electrostatic field is also created at the same time. However, this field is so small as to have negligible effect on the operation of the engine and serves no other function but to ignite the compressed gas. Examples of internal combustion ignition systems are disclosed in U.S. Pat. Nos. 1,393,702 of Sanchez; 2,253,204 of Delucci and 3,349,760 of Horan. However, none of these involve the deliberate creation of a sufficient electrostatic field to supplement the force of internal combustion.

SUMMARY OF THE INVENTION

The present invention is directed to increasing the power of internal combustion engines in a stable manner regardless of atmospheric pressure changes and without creating additional pollution. This is accomplished by imparting electrostatic force to the pistons of an internal combustion engine at the proper time so as to augment the engine power.

In an illustrative embodiment of the invention a plate is installed in the piston cylinder. Charge is accumulated in a capacitor and is transferred to this plate at the appropriate time in the movement of the piston so as to create an electrostatic field that supplements the energy of the internal combustion engine.

The energy for the capacitor is initially derived from a direct current source, such a vehicle battery. An electrical motor which is driven at a speed in excess of the engine speed is used to operate a switch which supplies the battery voltage in the form of a chopped or square wave signal to the primary of a high voltage transformer. The high voltage AC output of the transformer is rectified and stored in the capacitor. At the appropriate time in the piston movement, and acting under the control of the engine timing gears, a switch is closed such that the energy accumulated in the capacitor is transferred to the piston plate to establish a high electrostatic field between the capacitor plate in the piston chamber and the top of the piston face. This force is sufficient to impart additional energy to the piston.

As the piston begins to move away from the ideal position, the charge on the plate is removed such that it does not have an inhibiting effect on the piston movement. In the meantime, the supplemental capacitor is recharged such that its energy may be transferred again to the plate when the piston reaches the appropriate position once more.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
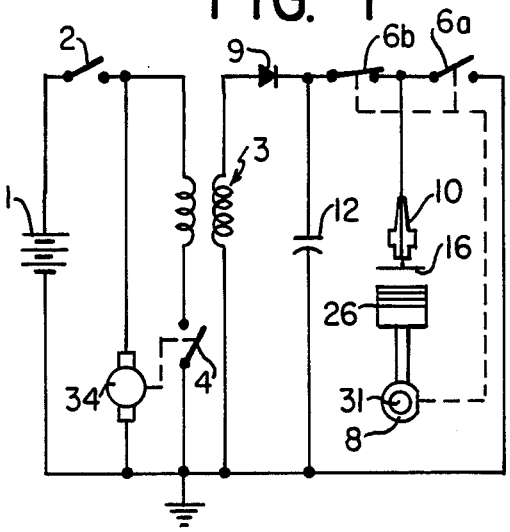
FIG. 1 is a simplified schematic view of the electrical circuit according to the present invention.

The present invention will now be described in detail with reference to the drawings, in which the same reference numerals are used to denote like parts appearing in FIGS. 1 through 3.

FIG. 1 indicates a battery 1, such as that typically found in a motor vehicle. This battery 1 may be connected to an electrical motor 34 through a switch 2 in order to turn on the electrical power enhancement apparatus according to the present invention. When power is applied to motor 34, it is also applied to one end of the primary winding of a transformer 3. The other end of this primary winding is connected through a switch 4 to the negative side of the battery 1 or ground. Switch 4 is operated at a high rate of speed by motor 34 such that a square wave or chopped voltage is generated across the primary of transformer 3.

Transformer 3 has a large step-up ratio so that the voltage at the output of its secondary is many times higher than the typical 12 or 6 volts of a vehicle battery. In particular, the output of the secondary may be several thousand volts.

The high voltage output of the secondary transformer is rectified by a diode 9 and stored in a capacitor 12. As a result, a very high DC voltage is stored in capacitor 12. As will be shown, this voltage is used to apply additional driving force to an internal combustion engine.

A crankshaft 31 of an internal combustion engine is shown in FIG. 1 attached to a piston 26 which is located in a piston cylinder. As crankshaft 31 turns, it also turns a multi-lobed actuator 8 which operates switches 6a and 6b such that when piston 26 is a few degrees before its top dead center position, switch 6b is closed and switch 6a is opened. With such an arrangement the full charge of capacitor 12 is applied to a plug 10. This plug is inserted through the cylinder head into the combustion space of the piston cylinder. At the end of this plug there is a plate 16 which is arranged parallel to the top face of piston 26. The charge on the plate from capacitor 12 creates an electrical field which tends to attract piston 26 with a certain force. This force is added to the force of combustion in the chamber which is initiated by a conventional spark plug (not shown).

After the piston passes the top dead center position actuator 8 reverses the positions of 6a and 6b shown in FIG. 1. As a result of this reversal the charge from capacitor 12 is no longer applied to plug 10 and any accumulated charge on plate 16 is discharged to ground through switch 6a. Therefore, as the piston recedes from plate 16, there is no attractive charge on plate 16 which would cause a decrease in the effective force created by conventional combustion.

As noted in the text, *Electromaonetics* by John D. Kraus, McGraw-Hill 1953, at page 5, the electrostatic force is equal to the electric field intensity E times the charge, i.e.

$$F = E.Q \tag{1}$$

In the Kraus text at page 61 equation (2–54) indicates that the charge is equal to the area of parallel plates, A, multiplied by the permeability, e, of the medium between the plates. Also the field intensity E is equal to the voltage V divided by the distance between the plates. In particular, there is a second equation, i.e.

$$Q = AeE = Ae\frac{V}{l} \tag{2}$$

By substituting equation 2 into equation 1, we can determine the equation for force as follows:

$$F = V^2Ae/l^2 \tag{3}$$

In this equation, the area A and the separation distance l are in meters, the voltage V is in volts, and the force F is given in newtons.

If we assume that the diameter of the piston head is 10 cm, the separation between the piston head an plate 16 is 1 mm at the top dead center position of the piston and the voltage applied to plate 16 is equal to 30,000 volts, the force is 62.55 newtons or 14 pounds. A piston force which is 10 cm in diameter has an area of about 12 square inches, which indicates 1 pound per square inch of additional force is applied to each piston head as a result of the present invention. The permeability was assumed to be 1, but compressed gasoline has a greater permeability so the force may be greater and the potential for electrical breakdown less.

The details of the calculation are as follows:

$$d = 10 \text{ cm} = 10 \times 10^{-2} \text{ m}$$

$$l = 1 \text{ mm} = 1 \times 10^{-3} \text{ m}$$

$$A = \tfrac{1}{4}\pi d^2 = 0.7854\,(10 \times 10^{-2})^{-2} = 7.854 \times 10^{-3}$$

$$v = 30{,}000 \text{ volts} = 3 \times 10^4 \text{ volts}$$

-continued $$e = 8.85 \times 10^{-12} \text{ farads/m}$$

$$F = \frac{V^2Ae}{l^2} \text{ (newtons)}$$

$$F = \frac{(3 \times 10^4)^2 \times 7.854 \times 10^{-3} \times 8.85 \times 10^{-12}}{(1 \times 10^{-3})^2}$$

$$F = \frac{9 \times 10^8 \times 7.854 \times 10^{-3} \times 8.85 \times 10^{-12}}{1 \times 10^{-6}} = 625.57 \times 10^{-9}$$

$$F = \frac{6.255 \times 10^{-5}}{1 \times 10^{-6}} = 62.55 \text{ newtons}$$

If the voltage applied to plate 16 is decreased to 6000 volts, the force decreases to 0.047 pounds per square inch. As indicated previously, prior art turbochargers seldom produce over 8 pounds per square inch and result in a boost of about 50% in the horse power of an internal combustion engine. It can be seen that the present invention with 6000 volts produces in excess of a 0.25% increase in the horse power of the engine while 30,000 volts produces in excess of a 6% increase.

The arrangement shown in FIG. 1 applies a positive charge to the plate 16 while the piston face is grounded. Thus there is a force of attraction between the two and the voltage is applied to plate 16 as the piston head approaches top dead center. It is also possible, however, to rearrange the circuits so that piston 26 and plate 16 have like charges and, as a result, are repulsed by each other. In such a case the charge would not be applied to plate 16 until after the piston has gone past top dead center and is moving away from the plate 16.

Only a single transformer and chopper switch 4 are shown in FIG. 1. However, it is within the contemplation of the present invention that a series of such devices could be provided in order to accumulate sufficient charge on capacitor 12 between rotations of crankshaft 31.

Figure 2:
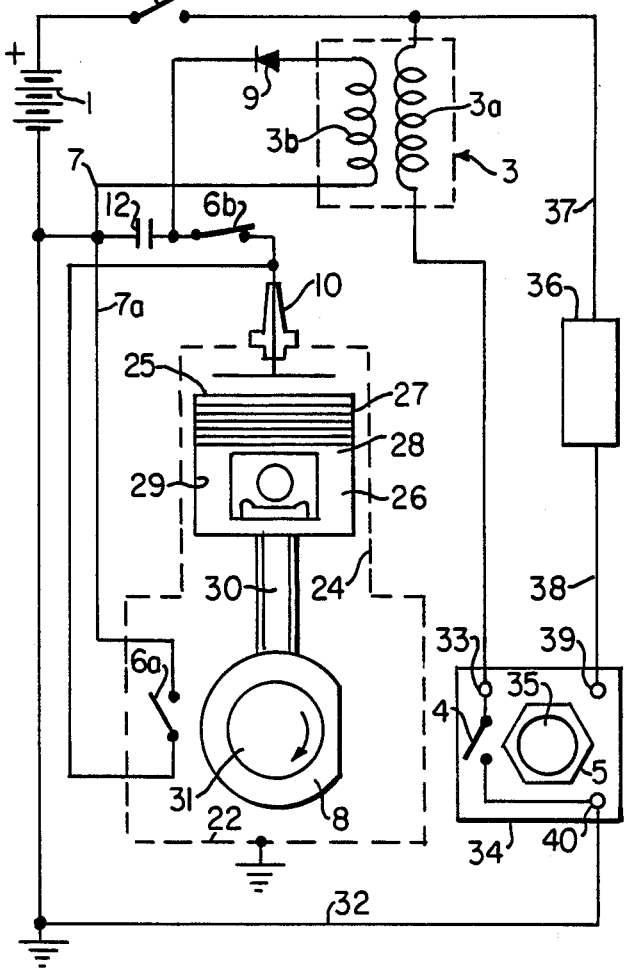
FIG. 2 is a more detailed schematic of the electrical circuit in conjunction with the structure of the engine with which it is associated.
Figure 3:
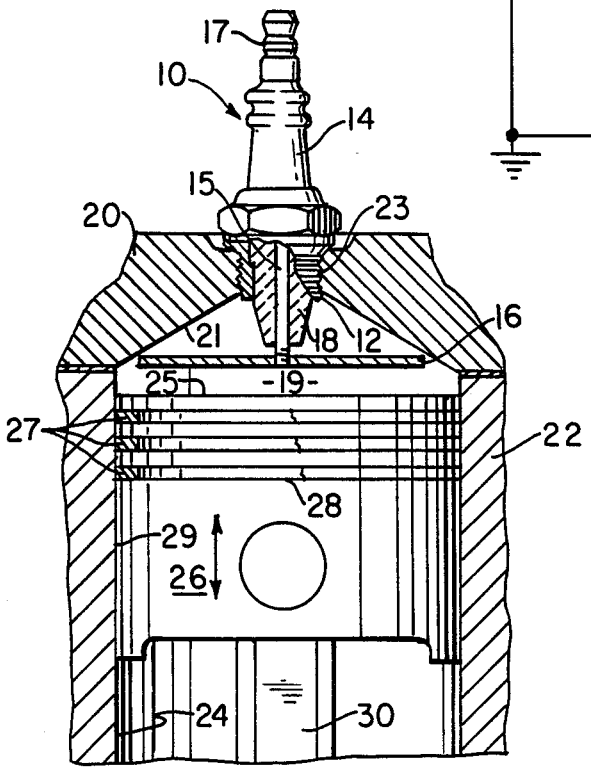
FIG. 3 is a partially sectioned view of the piston cylinder of an internal combustion engine equipped with the present invention.

In FIGS. 2 and 3 more of the details of the circuit of FIG. 1 are shown. However, similar parts are marked with the same reference number for the sake of clarity. As with the arrangement of FIG. 1, switch 2 is an on/-off switch which will either apply or disconnect the electrical boost circuit of the present invention. If switch 2 is open, the internal combustion engine operates in its normal fashion. In particular, a fuel-air mixture is injected into the combustion space 19 located between the piston face 25 and the inner face 21 of cylinder head 20 (FIG. 3 . The means for injecting this fuel is not shown. As face 25 of piston 26 moves upward, the fuel-air mixture is compressed. At the proper moment in the cycle this mixture is ignited by a spark created by a spark plug (not shown) The mixture then explodes creating a force on face 25 of the piston 26 which drives the piston downward (FIG. 3). The movement of the piston causes piston rod 30 to move down, which in turn causes crankshaft 31 (FIG. 2) to rotate.

Typically, there will be four or more of the piston cylinder arrangements shown in FIGS. 2 and 3 for the internal combustion engine of a vehicle. These are caused to operate sequentially so that a relatively smooth rotation of the crankshaft is achieved. This crankshaft is in turn connected through gears to the driving wheels of a vehicle. While the engine is running the present booster system can be turned on by closing switch 2, the effect of which is to add additional pressure or force onto the piston face so that the engine has more driving power.

When switch 2 is closed, a current flows from battery 1 through line 37 to a motor control circuit 36. This circuit determines the amount of voltage and/or current applied to motor 34 through conductor 38. Control circuit 36 thus determines the speed of rotation of the output shaft 35 of motor 34. Attached to shaft 35 of the motor is a multi-lobed actuator 5 which causes switch 4 to open and close at a rapid rate.

The speed of motor 34 and the number of lobes provided thereon causes the switch 4 to switch at a rate which is much higher than the rotation speed of crankshaft 31, which may be for example be in the range of 1000–7000 revolutions per minute. Switch 4 will be opened and closed at a rate at least 10 times higher, and preferably more.

As explained with respect to FIG. 1, the opening and closing of switch 4 causes alternating current to flow from battery 1 through the primary winding 3*a* of transformer 3 and switch 4 to ground or the negative side of battery 1 through conductor 32. This produces a square wave or chopped alternating current signal which is stepped up in voltage by transformer 3. For example there may be a 200 to 600 turns ratio between the primary 3*a* and the secondary 3*b*. Thus, the output voltage from the secondary 3*b* may be in the range of 2400 to 7200 volts if battery 1 is a conventional 12 volt automotive battery.

The high voltage generated at the secondary 3*b* of transformer 3 is rectified by high voltage diode 9 and is stored in capacitor 12. The rectification by diode 9 results in a DC voltage which is approximately half the value of the voltage generated at the output of the transformer. While the voltage is being stored in capacitor 12, switch 6*b* will be in the open position and switch 6*a* in the closed position. Thus, any charge on plate 16 will be grounded and there will be no drain on the charge being build up in capacitor 12. In the arrangement shown this will occur in a cycle of crankshaft 31 starting at the time the piston passes the top dead center position.

As the piston moves downward and away from plate 16, charge is being build up in capacitor 12 and plate 16 has no charge. Thus, there is no force of attraction between the piston face 25 and plate 16 which would reduce the effect of the combustion on the piston. By the time the piston has reached its lowest position and begun to return upwardly, full charge has been established in capacitor 12. Soon after this point, single lobe actuator 8 located on crankshaft 31 causes switch 6*a* to open and 6*b* to close. In a typical operation, the actuator 8 on crankshaft 31 is arranged to operate switch 6*b* to apply the attractive voltage to plate 16 when the piston is approaching plate 16. As a result of this high voltage there is an electrostatic force of attraction between plate 16 and face 25 of the piston, which is grounded. This force of attraction as illustrated above can add several pounds per square inch of force to the piston.

The force of attraction is applied at a most advantageous time in the piston cycle. The piston was initially driven down by the force of combustion and as it begins to rise up, it is nearing the end of the effect of that force and is getting ready to receive another combustion force to drive it down again. Right at this point when the effect of the prior combustion is a minimum, the attractive force created by the present invention is applied, thereby boosting the power of the engine.

While a single capacitor 12 is shown in the circuit it could in fact be a bank of heavy-duty electrolytic capacitors which supply sufficient charge to operate the system according to the present invention.

As more clearly shown in FIG. 3, a spark plug type device 10 is utilized to apply the electrostatic voltage charge in the piston cylinder so as to supplement its operation according to the present invention. The voltage from capacitor 12 is applied through 6*b* to terminal 17 of plug 10. This conducting terminal is connected internally by an internal conductor 15 to the plate 16. However, the conductor 15 and the plate are insulated from the cylinder head 20 by an insulating material 18 which material may extend into contact with and aid in the support of plate 16.

In order to install this plug, a threaded aperture must be provided in the cylinder head so that the plug 10 may be screwed into it, much in the manner of a conventional spark plug. In addition, the cylinder head 20 must be removed so that the plate 16 can be attached to the end of inner conductor 15, for example by threading.

The piston 26 has conventional grooves 28 with rings 27 resiliently contacting the cylinder wall 24. The piston skirt 29 also slidingly fits against the cylinder wall 24 providing electrical contact between the piston 26 and the engine block 22. Connecting rod 30 provides mechanical coupling of the piston 26 to the rotatable crankshaft 31 as shown in FIG. 2. The electrical motor 34 is mounted on engine block 22 in FIG. 2.

If it were desired to impart the electrostatic force to the piston by means of repulsion, as opposed to attraction, it would be necessary to insulate top face 25 of the piston from the rest of the piston body. This is because the rest of the piston in ordinary operation is in contact with engine block 22, which is typically grounded in a vehicle with respect to the battery. With top face 25 insulated, a large positive charge is applied to plate 16 which is similar to the charge induced on plate 16 so as to cause the two to repel each other.

As an alternative to insulating face 25, the cylinder walls would have to be modified so as not to be grounded and to include an electrical terminal which applies charge to the top face 25 as it passes the terminal. Under these circumstances a large positive voltage charge is applied to face 25. Then, when the piston is past top dead center, a similar electrical charge is applied to plate 16 causing a repulsive force between the two which would add additional power to the engine. Since this second alternative requires modifications to the engine block, it is more costly to implement.

Although a reciprocal piston engine is generally illustrated in the specification for the employment of the electrostatic supplementing system of the present invention, this invention will also operate with the well known rotary engines which use a multi-sided rotor which moves with a circular motion in an enclosed chamber.

While the present invention has been particularly shown and described with reference to a preferred embodiment thereof, it will be understood by those skilled in the art that various changes in form and details may be made therein without departing from the spirit and scope of the invention.

We claim:

1. An apparatus for an engine having a cyclically moving drive member driven in an engine chamber with walls by a primary power source, comprising a charge storage device;

means for applying charge to said storage device between cycles of the moving drive member;

an electrostatic plate positioned at a distance from the chamber walls so as to be closer to and adjacent the drive member at one point in its cycle of movement;

means for applying charge from said storage device to said electrostatic plate when the drive member is in a first position of its cycle so as to create an electrostatic force between said plate and the drive member which aids the movement of the drive member; and means for removing the charge from said plate when the drive member is in a second position of its cycle so as to prevent the electrostatic force from hindering the movement of the drive member.

2. An apparatus as claimed in claim 1 wherein the charge storage device is at least one capacitor.

3. An apparatus as claimed in claim 1 wherein the electrostatic force is a force of attraction and the first portion of the cycle of the drive member occurs as the drive member approaches said electrostatic plate.

4. An apparatus as claimed in claim 1 wherein the electrostatic force is a force of repulsion and the first portion of the cycle of the drive member occurs as the drive member moves away from said electrostatic plate.

5. An apparatus as claimed in claim 1 wherein said means for applying charge is a source of high, generally direct current, electric voltage.

6. An apparatus as claimed in claim 1 wherein said electric voltage is at least 2000 volts.

7. An apparatus as claimed in claim 5 wherein said means for applying charge comprises:

a DC voltage source;

a step-up transformer with a primary winding having a particular number of turns and a secondary winding having a greater number of turns;

means for intermittently applying current from said DC voltage source through the primary winding of said transformer; and means for rectifying the voltage at the secondary of said step-up transformer and applying the current from the secondary of said step-up transformer to said charge storage device.

8. An apparatus as claimed in claim 7 wherein said means for intermittently applying current is a switch operated by a multi-lobed actuator on a shaft of an electric motor.

9. An apparatus as claimed in claim 7 wherein said means for rectifying is a diode.

10. An apparatus as claimed in claim 1 wherein the engine is an internal combustion engine and said moving drive member is at least one piston of the engine moving in a piston chamber of the engine and driving a crankshaft.

11. An apparatus as claimed in claim 10 wherein said electrostatic plate is a plate positioned in the piston chamber above the top dead center position of the piston, said plate being held by a plug that insulates the plate from the piston chamber and extends from within the piston chamber to outside the engine, said plug further having a center conductor leading from said electrostatic plate to the outside of the engine, said electrostatic plate and a top face of the piston having the electrostatic force between them.

12. An apparatus as claimed in claim 11 wherein said means for applying charge comprises:

a DC voltage source;

a step-up transformer with a primary winding having a particular number of turns and a secondary winding having a greater number of turns;

means for intermittently applying current from said DC voltage source through the primary winding of said transformer; and means for rectifying the voltage at the secondary of said step-up transformer and applying the current from the secondary of said step-up transformer to said charge storage device.

13. An apparatus as claimed in claim 12 wherein said means for intermittently applying current is a first switch operated by a multi-lobed actuator on a shaft of an electric motor, the number of lobes and the speed of the electric motor being such that the switch opens and closes at least a predetermined number of times for each rotation of the crankshaft, the speed of the motor being controlled by a control device.

14. An apparatus as claimed in claim 13 where the predetermined number is at least 10.

15. An apparatus as claimed in claim 13 wherein:

said means for applying charge is a second switch operated by an actuator on the crankshaft so as to open and close the switch once in each rotation of the crankshaft; and said means for removing charge is a third switch operated by the actuator on the crankshaft so as to close and open the switch once in each rotation of the crankshaft.

* * * * *